United States Patent [19]

Heaney

[11] 4,004,370

[45] Jan. 25, 1977

[54] INSULATED DOOR MOUNTING FRAME STRUCTURE

[75] Inventor: James J. Heaney, Glendale, Calif.

[73] Assignee: Anthony's Manufacturing Company, Inc., San Fernando, Calif.

[22] Filed: Mar. 3, 1975

[21] Appl. No.: 554,593

[52] U.S. Cl. ..... 49/70; 49/504

[51] Int. Cl.[2] ..... E06B 7/12

[58] Field of Search ..... 49/70, DIG. 1, 504

[56] References Cited

UNITED STATES PATENTS

| | | | |
|---|---|---|---|
| 2,858,408 | 10/1958 | Barroero | 49/70 |
| 3,629,972 | 2/1970 | Rehberg | 49/70 |
| 3,673,735 | 7/1972 | Winsler et al. | 49/70 |

FOREIGN PATENTS OR APPLICATIONS

| | | | |
|---|---|---|---|
| 962,017 | 4/1957 | Germany | 49/DIG. 1 |

*Primary Examiner*—Kenneth Downey
*Attorney, Agent, or Firm*—Kleinberg, Morganstern, Scholnick & Mann

[57] ABSTRACT

In a refrigerator door mounting frame, the use of a thermal barrier between the cold portion and the warm portion of the frame in combination with a divided thermal conduction path extending from an intermediate portion into the cold portion. The divided path comprises a thick load-bearing section through which conduction is impeded by the thermal barrier, in parallel with a thinner sealing face plate section exposed to the air outside the refrigerator and electrically heated to prevent condensation. In this way condensation is prevented and the heat load on the refrigerator is minimized.

15 Claims, 4 Drawing Figures

INSULATED DOOR MOUNTING FRAME STRUCTURE

BACKGROUND OF THE INVENTION

1. Field of the Invention

The present invention is in the field of the refrigerators and in particular, relates to commercial upright type refrigerators. The present invention is an improved door mounting frame structure for such refrigerators.

A refrigerated cabinet door and door mounting frame structure system is shown in U.S. Pat. No. 3,724,129 to Stromquist, issued Apr. 3, 1973. In essence, there is shown a refrigerated cabinet or room having a rectangular opening in one of its vertical walls. A door mounting frame structure is inserted within this opening, and the vertically hinged doors are mounted within the frame structure. Generally, the frame structure and the door frames are made of metal because of the durability and appearance of that material and the ease with which it may be manufactured. Most metals, however, are superior conductors of heat.

If preventive measures were not taken, the metalic door mounting frames and to some extent the door frames themselves would tend to operate at a temperature at or below the dew point of the air outside of the refrigerator. Under conditions of high humidity, condensation and frost can form. These effects are undesirable, not only because they detract from the appearance and the safety of the doors, but also because they graphically show a considerable waste of energy.

To prevent condensation and frost from forming on the door mounting frame structure, it has become the practice to provide a submerged electrical heating wire located within the door mounting frame structure which, when supplied with electrical current generates a small amount of heat, adequate to prevent condensation. U.S. Pat. No. 3,612,821 to Stromquist issued Oct. 12, 1971 illustrates the manner in which the electrical heating wires are arrayed within the door mounting structure. Although the use of the heater wires does not consume a large amount of energy relative to the total energy consumed by most refrigerators, nevertheless it is desirable to conserve energy by providing a door frame mounting structure which is thermally as efficient as possible.

The structure described in U.S. Pat. No. 3,612,821 includes several portions. A first portion generally slightly below ambient temperature extends from the outside of the refrigerator inward forming a door jamb. A second portion extends perpendicular to the first (jamb) portion and parallel to the wall of the refrigerator, forming a door buck portion. The end of the buck portion opposite the jamb portion is in contact with the cold air inside the refrigerator.

The intermediate part of the buck portion is provided with a sealing surface against which the magnetic sealing gasket of the door seats, preventing the flow of air between the door and the door frame. Because this sealing area is adjacent the coldest part of the door mount frame, the problem of condensation and frosting is particularly acute in that area. For this reason, a heater element is usually located there.

Condensation cannot form on a surface which is maintained at a temperature above the dew point temperature of the air next to the surface. The dew point temperature depends strongly on the relative humidity of the air, but never exceeds the temperature of the air. For this reason, the temperature of the heated area is maintained above the dew point, between room temperature and the temperature of the interior of the refrigerator.

Nilsen in U.S. Pat. No. 3,204,324 issued Sept. 7, 1965, shows a method for producing an insulating construction or structural member for use in windows, wall panels, ventilators, mullions and the like, wherein the structural members on the exterior and interior of the walls are separated by an insulating spacer.

That method includes providing originally a metal strip having a channel into which solidifiable insulative material is poured and allowed to solidify, then removing a part of the original strip forming the channel. This leaves a final strip consisting of two parts of the original strip bonded to the insulative material but spaced apart from each other by it, whereby the thermally conductive path between the two parts is interrupted by the insulative material.

Holliday and Barker in U.S. Pat. No. 3,624,885 issued Dec. 7, 1971 describe a machine for producing the type of insulated structural member described in Nilsen.

Inserting an insulative section between the portion of the door mounting frame outside the refrigerator and the portion extending into the refrigerator would reduce the flow of heat from the outside ambient environment into the refrigerator interior. A large thermal gradient would exist across the insulative section, with the result that the sealing surface and other parts of the frame exposed to the air outside the refrigerator would be maintained at a temperature below the dew point. As a result, condensation and frosting would be a problem. One way to relieve this problem is to provide localized electrical heating in the area of the sealing surface.

Providing a given level of electrical heating in an insulated door frame structure has the effect of maintaining the portion of the door buck portion nearest the insulative section at a temperature lower than it would be if the insulation were not present. The overall heat load on the refrigerator is not necessarily less than it would be if the insulative section were not present because the heater must supply the heat required to elevate a section of the buck portion above the dew point. Thus, it does not appear efficient to provide electrical heating in an insulated door frame structure.

If a non-insulated door mounting structure is provided with an electrical heater wire as shown in U.S. Pat. No. 3,612,821, it would appear that no further advantage could be obtained by thermally isolating the part of the structure extending into the refrigerator from the part of the structure outside the refrigerator. The presence of the heater element between those parts decreases the thermal gradient between the part outside the refrigerator and the heater element while increasing the thermal gradient between the heater element and the part of the structure extending into the refrigerator. As a result, the flow of heat from the outside is retarded, much as it would be by insulation, while the flow of heat from the heater element to the interior of the refrigerator is augmented. In fact, adding insulation between the part outside the refrigerator and the area near the heater element would be detrimental, because otherwise the heat flowing into the area of the heater element from outside could assist in the prevention of condensation and frost in that area. Thus, it does not appear reasonable to add an insulative section to a non-insulated door mounting frame containing an electrical heater element.

From the above discussion it appears that the use of an insulative thermal barrier and the use of an electrically heated area are inconsistent approaches, and it is not obvious how the advantages can be obtained simultaneously.

SUMMARY OF THE INVENTION

The present invention combines the advantages of an insulative thermal barrier with the advantages of electrical heating. This is accomplished by use of a unique door frame design in which a divided thermal path is combined with a thermal barrier. The divided thermal path includes a relatively thick conductive structural load bearing element and a relatively thin and less conductive sealing surface face plate. These elements are joined at the end of the frame extending into the refrigerator, then separated in the area of the seal, then joined again in the area near the jamb portion. The thermal barrier may be located either in the jamb portion or in the relatively thick structural element near the jamb portion, depending on the embodiment. The thermal barrier greatly reduces the flow of heat from the refrigerator exterior in the relatively thick structural element. Condensation is prevented by the use of electrical heating elements, and the influx of heat to the refrigerator from the heating elements is minimized by the thinness of the heat path provided by the sealing surface face plate.

It has been found that the door mounting frame of the present invention achieves condensation-free operation with lower overall energy consumption than prior art door frames. Further, the structure of the present invention lends itself to mass production by extrusion techniques.

The novel features which are believed to be characteristic of the invention, both as to structure and method of manufacture, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
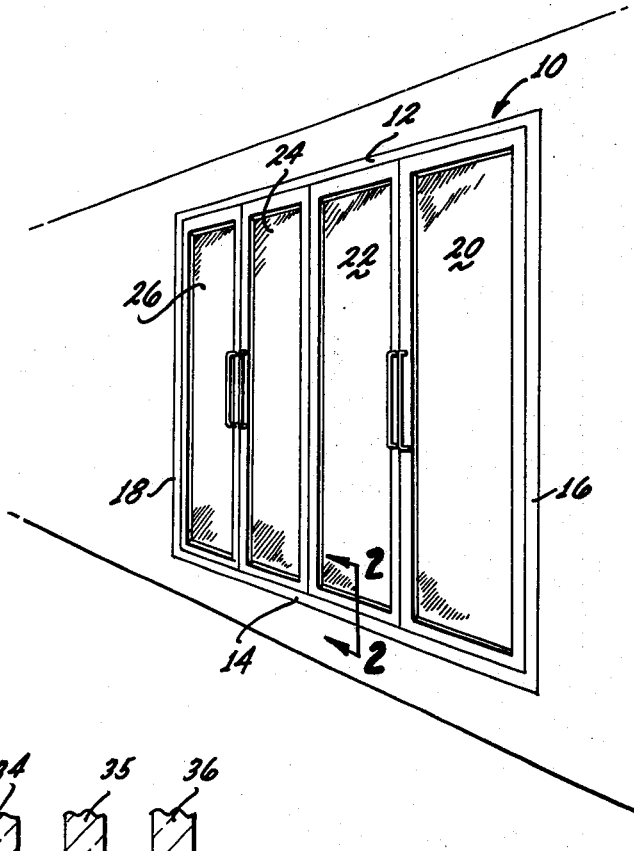
FIG. 1 is a perspective view of a multi-door refrigerator or freezer cabinet.

Referring now to the drawings, there is shown in FIG. 1 a commercial refrigerator door system, which includes a door mounting frame 10 having both horizontal members 12 and 14 and vertical members 16 and 18. Doors 20, 22, 24 and 26 are mounted within the door mounting frame. Typically, these doors include several layers of glass for permitting display of the merchandise within the refrigerator. The multiple layers of glass are spaced apart as more clearly seen in FIG. 4, to provide some degree of insulation. In addition, at least one of the panes of glass may be coated with a transparent electrically conductive layer through which an electrical current is passed to provide a heating effect which prevents condensation and frost from forming on the external surface.

Door mounting frame 10 is fitted into a rectangular frame which forms part of the structure of the refrigerated room. The structure of the cross section of door mounting frame 10 is substantially similar at all sides 12, 14, 16, and 18 of the door mounting frame. The door mounting frame must be strong enough to support the door in both the open and closed positions and to withstand the forces occurring when the door is closed and opened. These factors would suggest a relatively thick cross section for the frame. On the other hand, thermal conduction can be minimized by use of a thin cross section. It will be seen below that the present invention permits both a thick strong frame and low thermal conduction.

Figure 2:
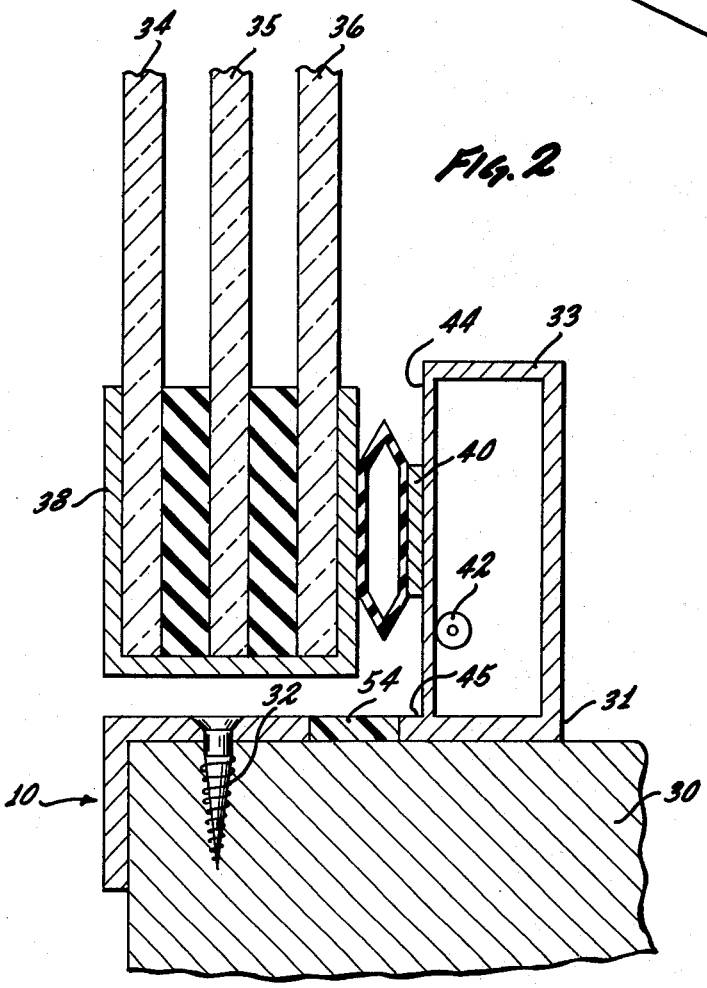
FIG. 2 is a cross-sectional view taken through lines 2—2 of FIG. 1.
Figure 3:
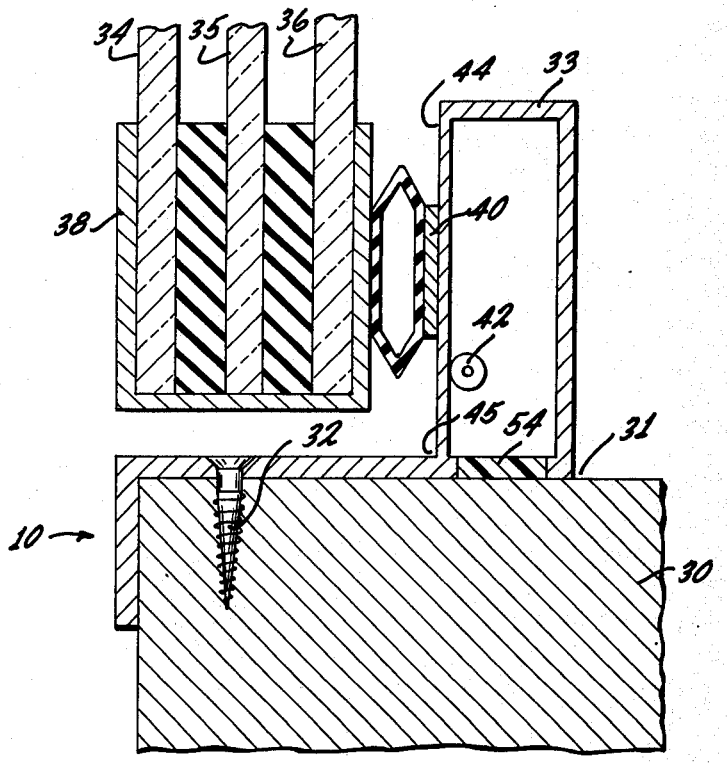
FIG. 3 is a cross-sectional view taken through lines 2—2 of FIG. 1 and showing an alternative embodiment.

FIGS. 2 and 3 are cross sectional views taken along the line 2—2 showing in greater detail how the door mounting frame 10 cooperates with the surrounding frame and with the refrigerator door. FIGS. 2 and 3 show the placement of the thermal barrier and the divided heat paths, which combination is the kernal of the present invention. In the idealized embodiments shown in FIGS. 2 and 3, the door mounting frame 10 is secured to the framework 30 by means of screws such as that shown at 32. In another embodiment best seen in FIG. 4, insulating material 70 and an electrical conduit 72 are provided adjacent the frame of the refrigerated room and the door mounting frame 10.

The panes of glass 34, 35, and 36, spanning the door are held together by a door frame 38 to which is attached a magnetic sealing member 40 which runs all the way around the door and which maintains a tight seal against cover plate 44 by magnetic attraction. Although three panes of glass are shown, doors having two panes or even one pane are not uncommon, though less efficient. The cover plate 44 is heated by heater element wire 42.

As can be seen from FIG. 2, the functions of the door mounting frame is to provide a well-defined stop or buck to prevent the door from swinging into the refrigerator, to provide a smooth surface adapted for sealing to magnetic sealing strip 40, to provide a conduit for heater element wires and to provide an attractive and durable frame in which the doors can be mounted.

The door mounting frame shown in FIGS. 2 and 3 includes a portion outside the magnetic sealing strip and a portion extending into the refrigerator which is indicated as lying generally along the path 31-33-40. As shown in FIGS. 2 and 3, these two portions are separated by thermal barrier 54.

Were it not for thermal barrier 54 a large amount of heat would flow from the portion outside the refrigerator toward the portion extending into the refrigerator. Most of that heat, upon reaching the branch point 45 would flow into the relatively wide conductive path 45-31-33. The placement of the thermal barrier 54 as shown in FIGS. 2 and 3 prevents this by blocking that path. The width of the material along that path must be sufficient to provide adequate structural strength and rigidity to the frame.

Some of the heat generated by heater element 42 flows through the sealing face plate 44 toward the cold end 33 of the cross section. This heat flow into the refrigerator is unavoidable in the embodiments of the present invention shown in FIGS. 2 and 3. In the embodiment of FIG. 2, a small amount of heat from the heating element 42 also flows into the refrigerator by the path 42-45-31-33, while in the embodiment of FIG. 3, this path also is broken by thermal barrier 54. The required flow of heat from heater element 42 is reduced significantly by forming sealing face plate 44 as thin as possible consistent with the mechanical requirements on it.

In other embodiments, the structural portion 31–33 of the door buck is not required to be parallel to the sealing face plate, but instead could be angled with respect to jamb portion 50.

Thus, in the present invention the buck portion of the frame is formed as two heat paths: a highly conductive wide path providing strength and rigidity, and a poorly conducting narrow path forming the sealing face plate. Heat from the portions of the door frame outside the refrigerator is prevented from entering the wide path by a thermal barrier. The narrow path is heated by an electrical heating element to prevent condensation, but conduction of the heat generated by it is greatly retarded by the narrowness of the path. This unique structural combination prevents condensation while reducing the heat load on the refrigerator to a minimum.

Figure 4:
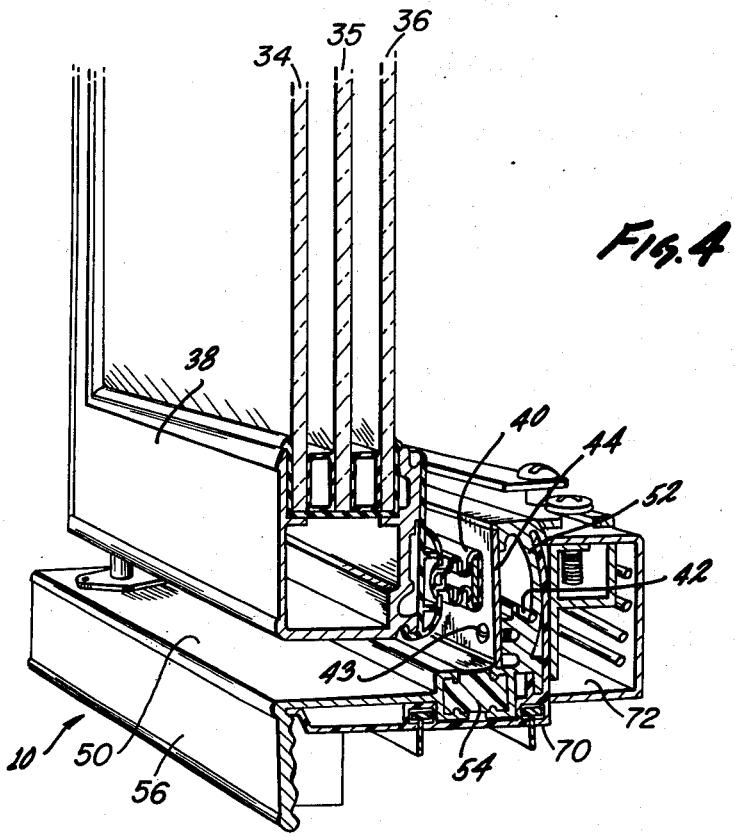
FIG. 4 is a perspective view, partially in cross-section, showing how the door mounting frame extrusion is related to the door and surrounding structure.

Although the sealing face plate of FIGS. 2 and 3 is shown as an integral part of the door buck structure, in some applications a more practical embodiment is obtained by making the sealing face plate a separable part, held in place by fastening means of which screw 43 shown in FIG. 4 is typical. This permits easy access to the heater element 42 which occasionally requires servicing. Further, a relatively poor thermal contact exists between such a removable sealing face plate and the structure to which it is attached. This further facilitates thermal isolation of the sealing face plate.

Ideally the heater element 42 is mounted in close proximity to the part of the structure to be heated and on which condensation would otherwise occur. In alternative embodiments the heater element can be attached to either the sealing face plate or to the remaining parts of the structure depending on the specific application intended.

Because in some applications a cold part of the jamb portion or a cold part of the door buck portion may be exposed to the air outside the refrigerator, it may be desirable to use the heater element to heat those portions also, as illustrated in the embodiment shown in FIG. 4.

In FIG. 4, the door mounting frame is seen in use, in a perspective view which is partly cut away. From FIG. 4, it can clearly be seen that portions 56 and 50 of door mounting frame are normally at room temperature and that a large temperature gradient exists across section 52 of the door mounting frame. The tip of section 52 is in contact with the cold air inside the refrigerated compartment and the heater element wire 42 provides warmth to the central portion of section 52 preventing condensation and frost from forming on cover plate 44 and on the exposed portions of the door mounting frame. As will be appreciated from the above discussion, one of the features of the present invention is confining the heat generated by the heater element to the minimum area necessary to accomplish its purpose.

The foregoing detailed description is illustrative of one embodiment of the invention, and it is to be understood that additional embodiments thereof will be obvious to those skilled in the art. The embodiments described herein together with those additional embodiments are considered to be within the scope of the invention:

What is claimed is:

1. A structural member for use in forming a door mounting frame for mounting into an opening in a refrigerated cabinet and within which frame a door can be operatively mounted, said structural member being a beam elongated in the longitudinal dimension and defined by its cross-section which comprises:

a. an elongated jamb portion adapted to abut the refrigerated cabinet opening;

b. an elongated buck portion extending perpendicularly from the longitudinal edge portion of said jamb portion adapted to be nearest the interior of the refrigerated cabinet, said buck portion comprising:

i. an elongated, relatively thick structural load bearing member ii. an elongated relatively thin faceplate adapted to coact in sealing relationship with the refrigerated cabinet door, said load bearing member and faceplate being disposed in mutually spaced relationship to define a divided thermal path in said buck portion;

c. a thermal isolation element positioned within said structural member in the area proximate the junction of said jamb and buck portions and thermally insulating the structural member components on opposite sides thereof.

2. The structural member of claim 1 in which said thermal isolation element is disposed entirely within said jamb portion.

3. The structural member of claim 1 in which said thermal isolation element is disposed entirely within said buck portion between said faceplate and said structural load bearing member.

4. The structural member of claim 1 in which said thermal isolation element is interposed between said jamb portion and said buck portion.

5. The structural member of claim 1 in which said load bearing member has a slot for receiving an edge of said faceplate.

6. The structural member of claim 1 in which said load bearing member has a slot for retaining a fastener adapted to secure said faceplate to said load bearing member.

7. The structural member of claim 1 further comprising heating means positioned in the area between said structural load bearing member and said faceplate for heating said faceplate to prevent the formation of frost or condensation thereon.

8. The structural member of claim 7 wherein said heating means comprises an electrical heater element and said buck portion includes a heater element retaining means for holding said electrical heater element.

9. A polygonal door mounting frame of elongated structural members having substantially similar cross-sections for mounting into a planar opening in a refrigerated cabinet and within which frame a door may be operatively suspended, comprising:

a jamb portion adapted to extend from outside the refrigerated cabinet inward in a direction substantially perpendicular to the plane of the opening and lining the periphery of the opening;

a door buck portion projecting from said jamb portion into the opening to prevent the door from being pushed into the refrigerated cabinet, said buck portion including a relatively thick structural load bearing member and a relatively thin faceplate disposed over the majority of the width in spaced relationship from said load bearing member to define a divided buck portion thermal path, said buck portion being positioned substantially parallel to the plane of the opening, and in contact with said jamb portion;

a thermal barrier portion extending the length of each structural member and interposed therein in the area proximate the junction of said door buck and jamb portions, separating the frame into two distinct thermal sections and rigidly connecting those sections and means for electrically heating said faceplate, said faceplate being attachable to said door buck portion by faceplate attaching means.

10. The frame of claim 9 in which said thermal barrier portion is disposed entirely within said jamb portion.

11. The frame of claim 9 in which said thermal barrier portion is disposed entirely within said door buck portion.

12. The frame of claim 9 in which said thermal barrier portion is interposed between said jamb portion and said door buck portion separating them and forming a rigid connection between them.

13. The frame of claim 9 in which said face plate attaching means further comprises a slot for receiving an edge of said face plate.

14. The frame of claim 9 in which said face plate attaching means further comprises a slot for retaining a fastener.

15. The frame of claim 9 wherein said means for electrically heating includes an electrical heater element and heater elements retaining means positioned in said buck portion for holding said electrical heater element.

* * * * *